US006934988B1

(12) United States Patent
Wetzler et al.

(10) Patent No.: US 6,934,988 B1
(45) Date of Patent: Aug. 30, 2005

(54) THERAPEUTIC TABLE

(76) Inventors: Rita Wetzler, 1324 Midcrest Rd., Camano Island, WA (US) 98282; Jim Blair, 1324 Midcrest Rd., Camano Island, WA (US) 98282

( * ) Notice: Subject to any disclaimer, the term of this patent is extended or adjusted under 35 U.S.C. 154(b) by 0 days.

(21) Appl. No.: 10/850,847

(22) Filed: May 24, 2004

(51) Int. Cl.[7] ..... A47C 17/66
(52) U.S. Cl. ..... 5/621; 5/735; 5/631; 5/930
(58) Field of Search ..... 5/621, 631, 632, 5/731, 735, 930

(56) References Cited

U.S. PATENT DOCUMENTS

| | | | | |
|---|---|---|---|---|
| 1,938,006 A | | 12/1933 | Blanchard | 606/245 |
| 2,089,854 A | * | 8/1937 | Pellegrini | 5/735 |
| 2,911,969 A | | 11/1959 | Woodward et al. | 601/166 |
| 3,464,069 A | * | 9/1969 | Bien | 5/110 |
| 3,988,793 A | * | 11/1976 | Abitbol | 601/11 |
| 4,596,384 A | * | 6/1986 | Blosser | 5/613 |
| 4,903,689 A | | 2/1990 | Lannertone | 606/243 |
| 4,973,034 A | * | 11/1990 | Michele | 5/617 |
| 5,054,471 A | | 10/1991 | Ohlson | 601/1 |
| D355,983 S | * | 3/1995 | Mutch | D6/361 |
| 5,400,449 A | * | 3/1995 | Satto | 5/631 |
| 5,412,824 A | * | 5/1995 | Emerson et al. | 5/632 |
| 5,438,715 A | * | 8/1995 | Jackman | 5/110 |
| 5,661,860 A | * | 9/1997 | Heitz | 5/632 |
| D392,145 S | * | 3/1998 | Thurston | D6/604 |
| 6,049,926 A | | 4/2000 | Amaral | 5/622 |
| 6,151,734 A | | 11/2000 | Lawrie | 5/640 |
| 6,190,338 B1 | | 2/2001 | Arndt | 601/115 |
| 6,295,668 B1 | * | 10/2001 | Nation | 5/110 |
| 6,588,034 B2 | * | 7/2003 | Nation | 5/110 |
| 2002/0016993 A1 | * | 2/2002 | Nation | 5/110 |
| 2002/0095723 A1 | * | 7/2002 | Nation | 5/110 |

FOREIGN PATENT DOCUMENTS

| | | | | |
|---|---|---|---|---|
| FR | 2687294 A1 | * | 8/1993 | A47C 27/00 |

* cited by examiner

*Primary Examiner*—Robert G. Santos
(74) *Attorney, Agent, or Firm*—John D. Gugliotta; Olen L. York, III

(57) ABSTRACT

A therapeutic table having rotatable breast recesses is a massage table with special recessed areas or "pockets" to accommodate and support a woman's breasts when she is lying face down. Two recessed pockets are provided only on one side of a panel that is situated within the body of the table at the location where a woman's breasts normally rest once she has her face positioned in the face cradle. Additionally, these pockets are lined with a stretchable material that accommodates and comfortably supports all sizes of breasts. The other side of the panel is flat to accommodate a man's chest. The massage therapist simply rotates the panel 360 degrees to the desired side, depending upon whether the client is male or female.

20 Claims, 5 Drawing Sheets

THERAPEUTIC TABLE

RELATED APPLICATIONS

The present invention was first described in Disclosure Document Registration 529,690 filed on Apr. 10, 2003 under 35 U.S.C. §122,37 C.F.R. §1.14 and MPEP § 1706. There are no previously filed, or currently any co-pending applications, anywhere in the world.

BACKGROUND OF THE INVENTION

1. Field of the Invention

The present invention relates generally to a therapeutic table and, more particularly, to a therapeutic table having a rotatable upper torso segment with two opposing surfaces, the first surface having a pair of breast recesses to accommodate the breast of women, and a second surface having a planar surface to accommodate men, and further comprising an abdominal recess for receiving and supporting the abdomen of a user.

2. Description of the Related Art

More and more people enjoy the benefits and relaxation provided by a body massage. Not only does it reduce tension, but also many feel it helps increase circulation and improve overall health. Most massages take place or at least begin with the person lying face down on a massage table, and as such, a face cradle is often attached to the top of the table to comfortably accommodate the face and keep it in a proper position, thereby eliminating strain on the neck by properly supporting the head. However, when a woman lies face down on a massage table, she does not have such a support for her breasts; as a result, she is often uncomfortable, detracting greatly from the enjoyment and health benefits of the massage. The same situation exists for women who must lie face down on an exam table or a physical therapy table. Accordingly, there is a need for a means by which women can lie face down on massage tables, exam tables, and the like without putting undo pressure on their breasts.

A search of the prior art did not disclose any patents that read directly on the claims of the instant invention; however, the following references were considered related:

U.S. Pat. No. 1,938,006, issued in the name of Blanchard, discloses a manipulative table for spinal correction having a deformable abdominal support with means for mounting and positioning of the support;

U.S. Pat. No. 2,911,969, issued in the name of Woodward et al., discloses a breast developer having a tiltable table with a basin unit receiving a woman's breasts for the application of hydrotherapy thereto;

U.S. Pat. No. 4,903,689, issued in the name of Lannertone, discloses a chiropractic treatment table having means for reducing stress on the chest or breast area of a patient comprising a pair of separated shoulder support means;

U.S. Pat. No. 5,054,471, issued in the name of Ohison, discloses a female breast treatment arrangement comprising a table having a through-going opening aligned with an opening in the table for receiving a woman's breasts;

U.S. Pat. No. 6,049,926, issued in the name of Amaral, discloses a head cradle for a therapy table;

U.S. Pat. No. 6,151,734, issued in the name of Lawrie, discloses a head support apparatus useful for converting a conventional bedding mattress set into a message table; and U.S. Pat. No. 6,190,338, issued in the name of Amdt, discloses a therapeutic massage table having a plurality of roller assemblies.

Consequently, there exists a continuous need for new ideas and enhancements for existing products in the massage table industry.

SUMMARY OF THE INVENTION

It is therefore an object of the present invention to provide an improved therapeutic table.

It is a feature of the present invention to provide a therapeutic table having a pair of recesses to accommodate the breasts of an individual, generally a female, the recesses provided in an upper torso segment selectively rotatable between the recesses and a substantially horizontally planar surface coextensive with the horizontally planar surface of the rest of the table.

Briefly described according to one embodiment of the present invention, a therapeutic table having rotatable breast recesses is a massage table with special recessed areas or "pockets" to accommodate and support a woman's breasts when she is lying face down. Two recessed pockets are provided only on one side of a panel that is situated within the body of the table at the location where a woman's breasts normally rest once she has her face positioned in the face cradle. Additionally, these pockets are lined with a stretchable material that accommodates and comfortably supports all sizes of breasts. The other side of the panel is flat to accommodate a man's chest. The massage therapist simply rotates the panel 360 degrees to the desired side, depending upon whether the client is male or female. In addition to being used on massage tables, such a concept could be easily incorporated into exam tables used by doctors, physical therapy tables, or any surface on which women may be required to lay face down. Tables used in the wet rooms of spas where clients receive water treatments could also incorporate such a feature.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
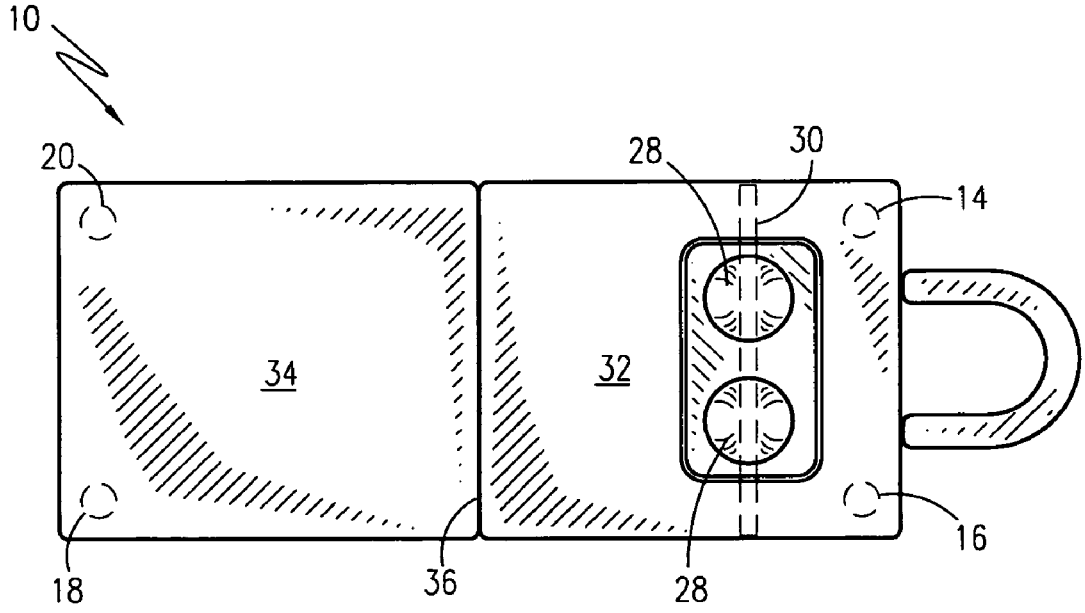
FIG. 1 is a top view of the therapeutic table with breast recesses.
Figure 2:
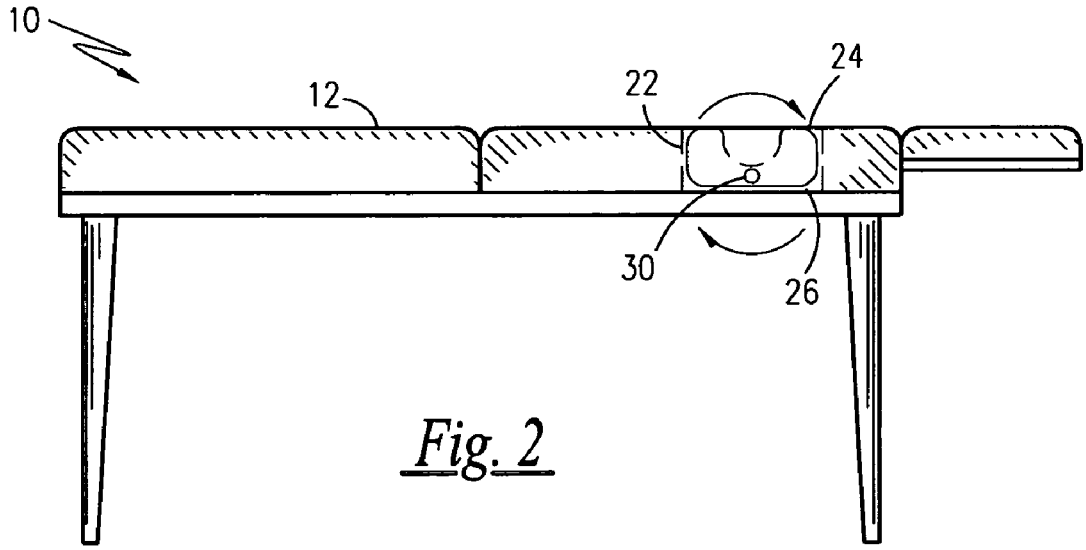
FIG. 2 is a side view of FIG. 1 with the breast recesses oriented for access.
Figure 3:
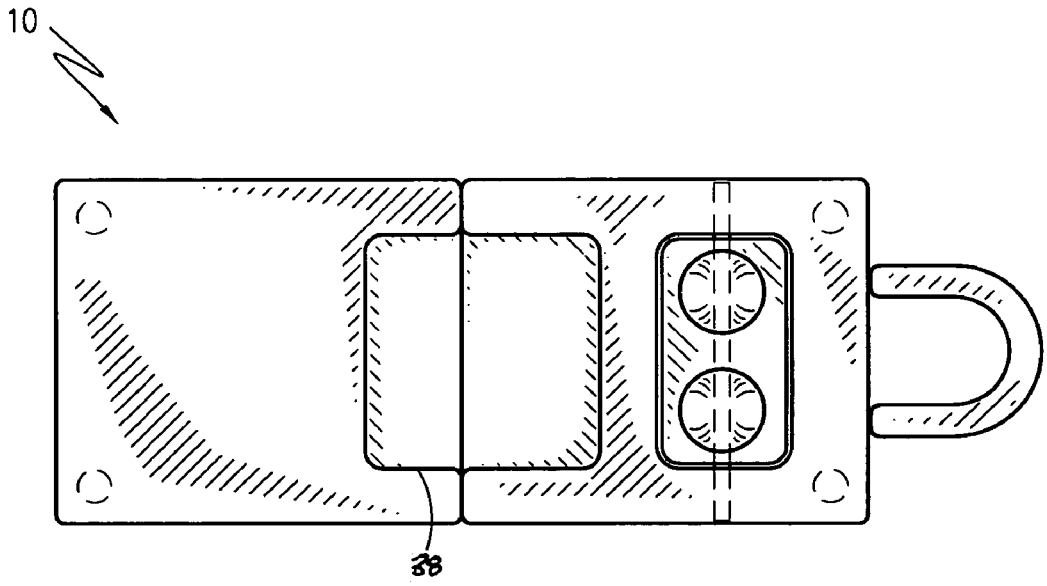
FIG. 3 is a top view of the table also having an abdominal recess.
Figure 4:
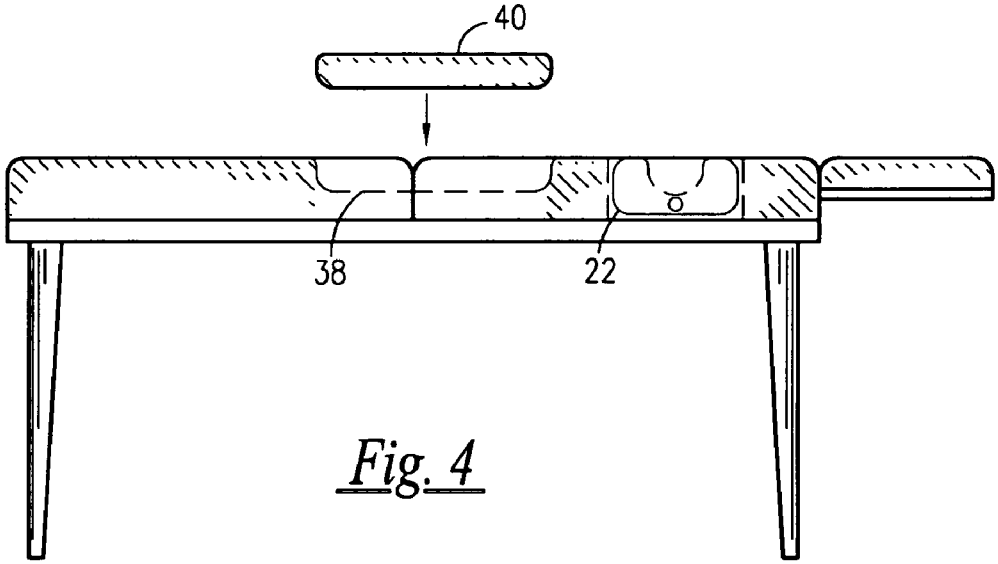
FIG. 4 is a side view of FIG. 3 also having a removable cover for enclosing and concealing the abdominal recess.
Figure 5:
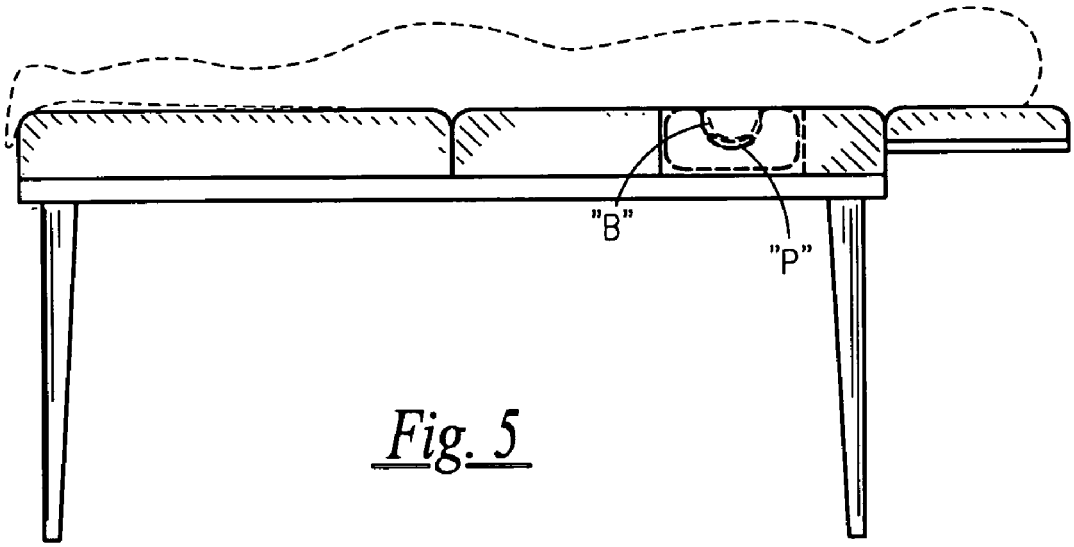
FIG. 5 is a side view of the table with a female laying thereon, the female breasts depending within the recesses and further supported by padding.
Figure 6:
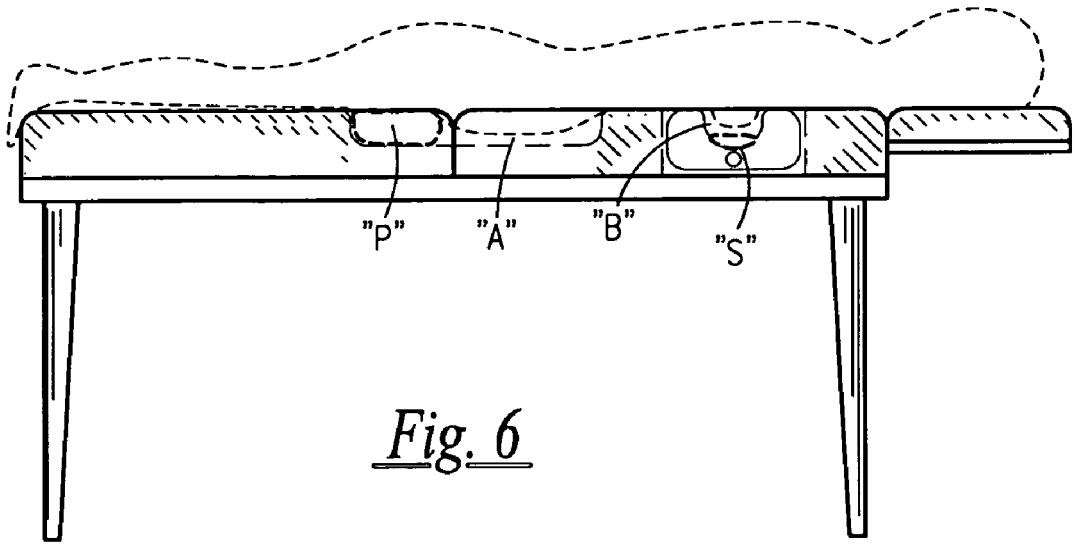
FIG. 6 is a side view of the table with a female laying thereon, the female breasts depending within the recesses and further supported by sand, and the female also utilizing the abdomen recess, the female abdomen further supported by padding.
Figure 7:
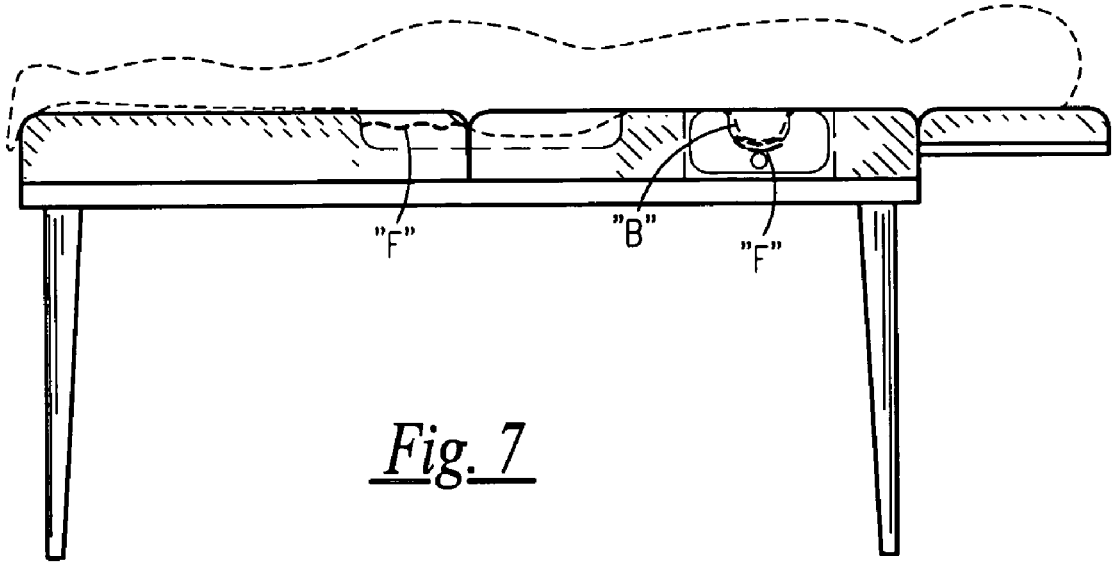
FIG. 7 is a side view of the table with a female laying thereon, the female breasts depending within the recesses and further supported by fluid, and the abdomen within the recess and further supported by fluid.
Figure 8:
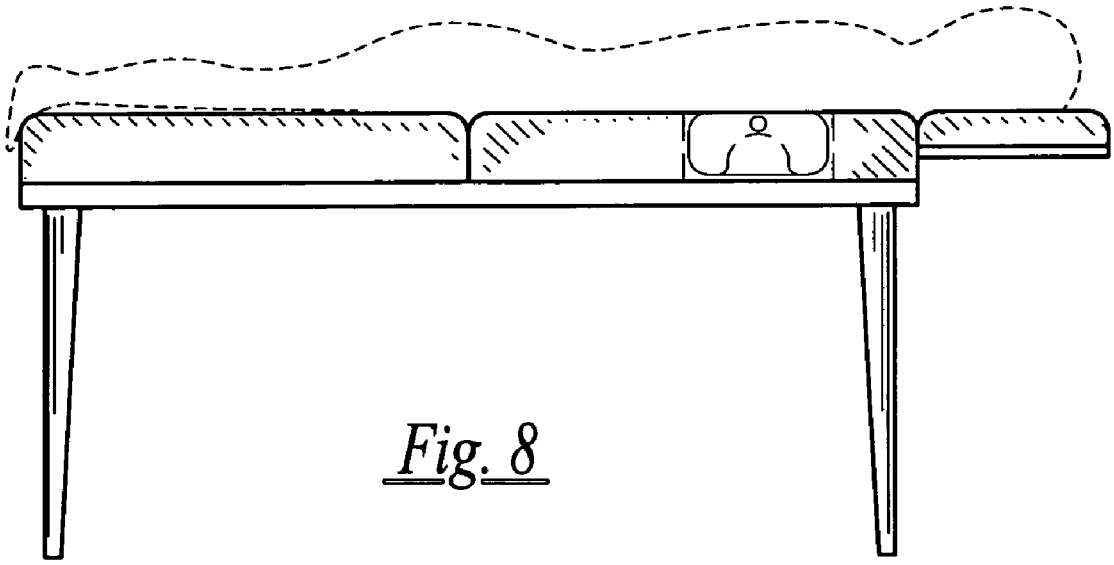
FIG. 8 is a side view of the table wherein the upper torso segment has been selectively rotated to access the substantially planar surface for a flat-chested male or female.

The best mode for carrying out the invention is presented in terms of its preferred embodiment, herein depicted within FIGS. 1 through 9.

1. Detailed Description of the Figures

Referring to FIG. 1 through FIG. 9, a therapeutic treatment table (hereinafter "table") is shown in accordance with a preferred embodiment of the present invention. The table 10 comprises a substantially planar support surface 12 supported on legs 14, 16, 18 and 20, the support surface 12 intended to align substantially horizontal to the floor, although adjustable for slight elevation or de-elevation of the head and/or legs. The support surface 12 has at least one recess 28 or 38 formed in the support surface 12 for accommodating the breasts "B" or the abdomen "A" of a user. The recess has a cover 40 that is co-extensive to the support surface 12. A second recess 28 or 38 may also be provided for accommodating the breasts "B" or the abdomen "A" of a user, whichever is requiring support not provided by the first recess 28 or 38.

The support surface 12 has an upper torso segment 22. The segment 22 has two opposing surfaces 24 and 26, the first surface 24 having a pair of recesses or pockets 28 for receiving and accommodating the breasts "B" of a woman, and the second surface 26 having a substantially planar surface coextensive to the support surface 12, thus accommodating men, flat-chest women, and children (see FIG. 8). The segment 22 is selective between the two surfaces 24 or 26 by rotation about an axle 30.

The support surface 12 comprises a first segment 32 and a second segment 34. Segments 32 and 34 may be coupled by means 36, such as a pivot or hinge so that segments 32 and 34 may be collapsed for ease of transport and/or storage. A segment 32 or 34 includes the upper torso segment 22. The remaining segment 32 or 34 supports the abdominal region and the legs of the treated party. In the example provided, and not intended to be a limitation on the scope of the invention, the first segment 32 includes the upper torso segment 22, and the second segment 34 supports the abdomen and legs. In an alternate embodiment, as depicted in FIG. 3, FIG. 4, FIG. 6 and FIG. 7, an abdominal recess or pocket 38 is provided in either the first segment 32 or the second segment 34, or both, depending upon the size of the desired recess 38. The abdominal recess 38 provides support to the abdomen "A" of one that may be overweight or pregnant. A removable cover 40 encloses and conceals the abdominal recess 38, the cover 40 coextensive with the generally horizontally planar support surface 12.

The recesses 28 for the breasts are envisioned to accommodate a majority of breast sizes. The breasts are positioned therein, depending within the respective recesses 28. It is envisioned that the recesses 28 may be partially filled with a comfortable supporting material, such as padding "P" (FIG. 5), sand "S" (FIG. 6) or fluid "F" (such as treated water—see FIG. 7) to further support the breasts within the recesses 28, and reducing the stress that may be imparted on the breasts by gravity.

The abdominal recess 38 is envisioned to accommodate a majority and variety of abdominal sizes. The abdomen (belly) is positioned therein, depending with the recess 38. It is envisioned that the recess 38 may be partially filled with a comfortable material, such as padding "P", sand "S" or fluid "F" to support the abdomen with the recess 38, reducing the stress that may be imparted on the abdomen by gravity.

Figure 9:
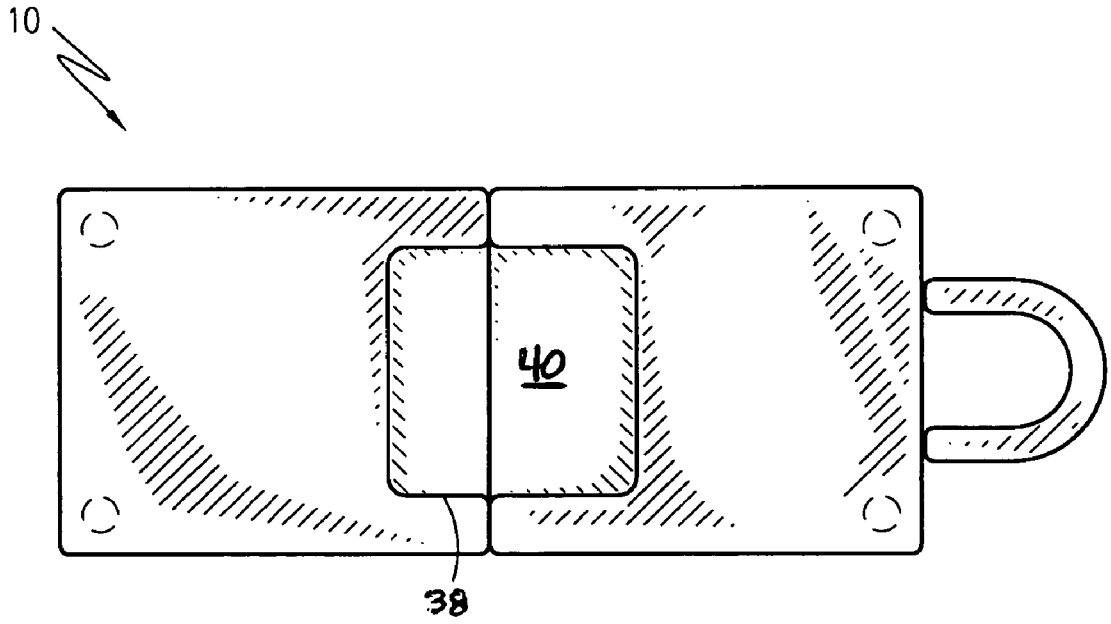
FIG. 9 is a top view of an alternate embodiment of the table having an abdominal recess only with a removable and replaceable cover.

As depicted in FIG. 9, the table 10 is envisioned as having an abdominal recess 38 and cover 40 apart from the combination disclosed in FIG. 3, FIG. 4, FIG. 6 and FIG. 7, respectively. The abdominal recess 38 is provided to receive, accommodate and support the abdomen of a user, especially a user that is overweight, obese and/or pregnant.

It is envisioned that the table 10 is particularly useful and advantageous with female users, especially female users that may suffer pain or discomfort from lying on their breasts and/or abdomens. In particular, female users having large breasts and/or a large abdomen, from either obesity or pregnancy, may benefit from using a table 10 providing breast recesses and/or an abdomen recess that receives and accommodates the breasts and/or abdomen for a comfortable and relaxing position.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the preferred embodiment of the present invention, a user will select the appropriate surface (recesses 28 or the flat surface 26). The user will lay on the table, positioning the torso so that if the breasts "B" require the recesses 28, then the breasts will depend therein. If the abdominal recess 38 is provided, then the user will align the abdomen with the recess 38 for comfort and support.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A therapeutic treatment table comprising:

a support surface supported on legs, said support surface having an upper torso segment;

said upper torso segment having two opposing surfaces, a first surface having a pair of recesses receiving and accommodating the breasts of a woman, and a second surface having a substantially planar surface coextensive to said support surface;

said upper torso segment selective between said first surface or said second surface by rotation about an axle;

said support surface comprises a first segment and a second segment, said first segment supporting the torso and said second segment supporting the abdomen and legs;

said first segment and said second segment may be coupled by means to collapse said table for ease of transport and/or storage.

2. The table of claim 1, wherein said first segment includes said upper torso segment.

3. The table of claim 2, wherein said recesses may be partially filled with a comfortable supporting material.

4. The table of claim 3, wherein said supporting material is a member selected from the group consisting of padding, sand and water.

5. The table of claim 1, wherein said second segment has an abdominal recess receiving and accommodating the abdomen of a user.

6. The table of claim 5, wherein said recesses may be partially filled with a comfortable supporting material.

7. The table of claim 6, wherein said supporting material is a member selected from the group consisting of padding, sand and water.

8. The table of claim 5 further comprising a removable cover placed over said abdominal recess substantially planar to said support surface.

9. A therapeutic treatment table comprising:

a support surface supported on legs;

an upper torso segment having two opposing surfaces, a first surface having a pair of recesses receiving and accommodating the breasts of a woman, and a second surface having a substantially planar surface coextensive to said support surface;

said segment is selective between said first surface or said second surface by rotation about an axle; and an abdominal recess receiving and accommodating the abdomen of a user.

10. The table of claim 9 further comprising a removable cover placed over said abdominal recess substantially planar to said support surface.

11. The table of claim 9, wherein said support surface comprises a first segment and a second segment, said first segment supporting the torso and said second segment supporting the abdomen and legs.

12. The table of claim 11, wherein said first segment and said second segment may be coupled by means to collapse said table for ease of transport and/or storage.

13. The table of claim 9, wherein said recesses may be partially filled with a comfortable supporting material.

14. The table of claim 13, wherein said supporting material is a member selected from the group consisting of padding, sand and water.

15. A therapeutic treatment table comprising:

a support surface supported on legs, said support surface having an upper torso segment;

said upper torso segment having two opposing surfaces, a first surface having a pair of recesses receiving and accommodating the breasts of a woman, and a second surface having a substantially planar surface coextensive to said support surface;

said upper torso segment selective between said first surface or said second surface by rotation about an axle;

said support surface having a first segment and a second segment, said first segment supporting the torso and said second segment supporting the abdomen and legs; and said second segment has an abdominal recess receiving and accommodating the abdomen of a user.

16. The table of claim 15, wherein said recesses may be partially filled with a comfortable supporting material.

17. The table of claim 16, wherein said supporting material is a member selected from the group consisting of padding, sand and water.

18. The table of claim 15 further comprising a removable cover placed over said abdominal recess substantially planar to said support surface.

19. The table of claim 15, wherein said first segment includes said upper torso segment.

20. The table of claim 15, wherein said first segment and said second segment may be coupled by means to collapse said table for ease of transport and/or storage.

* * * * *